US010132092B1

(12) United States Patent
Francies, III

(10) Patent No.: US 10,132,092 B1
(45) Date of Patent: Nov. 20, 2018

(54) RECESS INSERT FOR LIFT ANCHOR ASSEMBLY

(71) Applicant: MAESTRO INTERNATIONAL, LLC, Lithia, FL (US)

(72) Inventor: Sidney E. Francies, III, Lithia, FL (US)

(73) Assignee: Maestro International, LLC, Lithia, FL (US)

( * ) Notice: Subject to any disclaimer, the term of this patent is extended or adjusted under 35 U.S.C. 154(b) by 0 days.

(21) Appl. No.: 15/697,739

(22) Filed: Sep. 7, 2017

Related U.S. Application Data

(60) Provisional application No. 62/537,173, filed on Jul. 26, 2017.

(51) Int. Cl.

| | |
|---|---|
| ***E04G 21/12*** | (2006.01) |
| ***E04G 21/14*** | (2006.01) |
| ***E04G 15/04*** | (2006.01) |
| ***B28B 23/00*** | (2006.01) |

(52) U.S. Cl.
CPC ..... *E04G 21/142* (2013.01); *B28B 23/005* (2013.01); *E04G 15/04* (2013.01); *E04G 21/145* (2013.01)

(58) Field of Classification Search
CPC ..... E04G 21/12; E04G 21/125; E04G 21/142; E04G 21/145; E04G 15/04; E04B 1/41; E04B 1/35; E04B 1/3505
USPC ..... 52/677, 686, 125.4, 125.5; 248/346.01, 248/346.03
See application file for complete search history.

(56) References Cited

U.S. PATENT DOCUMENTS

| | | | |
|---|---|---|---|
| 2,794,336 | A | 6/1957 | Ballou |
| 2,838,821 | A | 6/1958 | Shur |

(Continued)

FOREIGN PATENT DOCUMENTS

| | | | |
|---|---|---|---|
| AU | 2009217422 | A1 | 4/2010 |
| DE | 3733703 | A1 | 4/1989 |

(Continued)

OTHER PUBLICATIONS

Walson Industrial Co., Limited; ARRF A-Anchor rubber recess former; http://www.walson.biz/pro_see.asp?nidn_rh393_34_54_dfd_46=67&xiaolei=778; 1 page; Copyright 2009; Shanghai, China.

(Continued)

*Primary Examiner* — Phi D A
(74) *Attorney, Agent, or Firm* — McGarry Bair PC

(57) ABSTRACT

A recess insert for a lift anchor assembly in a precast Portland cement concrete shape. The lift anchor assembly has a bilaterally symmetrical lift anchor comprising a lifting end, and an anchor leg end. The lifting end comprises an opening therethrough. The recess insert comprises a semi-circular shaped shell that defines an opening, a top cap shaped to cover the opening, at least one anchoring clip on the top cap, adapted to engage the opening of a lift anchor when the recess insert is cast with a lift anchor assembly in a precast Portland cement concrete shape for securing the top cap to the semicircular shaped shell. The top cap also has a disengagement plane or one or more apertures providing access to the at least one anchoring clip for disengaging the top cap from the lift anchor.

19 Claims, 5 Drawing Sheets

(56) References Cited

U.S. PATENT DOCUMENTS 4,367,892 A * 1/1983 Holt ..... B66C 1/666 294/82.31
4,386,486 A * 6/1983 Holt ..... E04C 2/526 52/125.5
4,474,387 A * 10/1984 Maranell ..... B62H 1/00 248/188.9
4,580,378 A * 4/1986 Kelly ..... E04G 21/142 52/125.4
4,627,198 A 12/1986 Francies, III
4,821,994 A * 4/1989 Fricker ..... B28B 23/005 249/177
4,866,903 A 9/1989 Ferstay
5,014,473 A * 5/1991 Kelly ..... B66C 1/666 294/82.35
5,509,636 A * 4/1996 Cotugno ..... E04C 5/167 24/336
5,829,207 A 11/1998 Mackay Sim et al.
6,082,700 A 7/2000 Lancelot, III et al.
6,095,483 A 8/2000 Mackay Sim et al.
6,401,409 B1 * 6/2002 Martin ..... E04H 9/12 220/4.24
6,460,824 B1 * 10/2002 Lancelot, III ..... B28B 23/005 249/183
6,550,834 B2 * 4/2003 Fromelius ..... B66C 1/666 294/89
6,575,424 B2 6/2003 Domizio
6,755,385 B2 * 6/2004 Lancelot, III ..... B28B 23/005 249/183
6,769,663 B2 8/2004 Kelly et al.
7,127,859 B2 10/2006 Domizio
7,222,460 B2 * 5/2007 Francies, III ..... E04G 15/04 52/125.5
D559,499 S 1/2008 Scott et al.
8,402,701 B2 3/2013 Arteon
8,667,746 B1 3/2014 Francies, III
9,151,065 B1 10/2015 Francies, III
2002/0134905 A1 * 9/2002 Domizio ..... E04G 15/04 249/91
2002/0195537 A1 12/2002 Kelly et al.
2003/0110715 A1 6/2003 Hansort
2003/0208968 A1 11/2003 Lancelot, III et al.
2004/0010985 A1 * 1/2004 Francies, III ..... E04G 15/04 52/125.4
2008/0196324 A1 8/2008 Mackay Sim
2008/0203270 A1 8/2008 Connell et al.
2009/0183441 A1 7/2009 Azarin
2009/0320386 A1 * 12/2009 MacKay Sim ..... B28B 7/002 52/125.4
2011/0067344 A1 * 3/2011 Swenson ..... E04C 5/168 52/677
2011/0191990 A1 8/2011 Beaulieu
2012/0011799 A1 * 1/2012 Beaumont ..... E04C 5/20 52/686
2012/0228443 A1 * 9/2012 Du ..... F16M 11/041 248/176.3
2013/0186012 A1 * 7/2013 Mackay Sim ..... B28B 7/002 52/125.5

FOREIGN PATENT DOCUMENTS

DE 10116673 A1 10/2002
WO 2012140329 A1 10/2012

OTHER PUBLICATIONS

Dayton Superior Corporation; product manual; p. 84 (1 page); Utility Anchor System; Miamiburg, Ohio, USA.
MeadowBurke Precast Products Manual, Rapid Lift System Anchors; 1 page; www.MeadowBurke.com; Tampa, Florida, USA.
Recess Inserts Photograph taken Oct. 9, 2015, photograph provided by inventor Skip Francies.

* cited by examiner

RECESS INSERT FOR LIFT ANCHOR ASSEMBLY

CROSS-REFERENCE TO RELATED APPLICATIONS

This application claims the benefit of U.S. provisional application Ser. No. 62/537,173, filed Jul. 26, 2017, which is incorporated by reference herein in its entirety.

BACKGROUND OF THE INVENTION

The invention may relate generally to a recess insert for a precast concrete lift anchor assembly for precast Portland cement concrete shapes. It is known to utilize precast Portland cement concrete shapes for installation on a construction project. Such shapes may be very heavy, which may necessitate the use of specialized equipment, such as cranes, helicopters, cables, chains, hooks, clutches, and the like, for safe lifting, moving, and installation.

Concrete shapes may be cast with integral metal lift anchors, to which hooks, cables, chains, and the like, may be attached for facilitating the handling of the concrete shapes. Such metal lift anchors may be heavy, large, and unwieldy. Their configuration may complicate the placement of reinforcing steel and prestressing strands, contributing to increased time and costs, and potentially increasing the risk of reinforcement and pre-stressing selection and installations failing to meet established or required standards. This may be due, in part, to preoccupation by a construction contractor or engineer with optimizing the balance between the load capacity of a lift anchor, and its cost and utility.

The lift anchor may be located within the concrete shape adjacent known prestressing strands. Factors such as the dimensions of the concrete shape, the designed location for the lift anchor within the concrete shape, the required number of lift anchors, the required number of prestressing strands, and the like, may control the spatial relationship of the lift anchor and the prestressing strands. This may result in undesirable crowding of the lift anchor and the prestressing strands. It may be necessary to reconfigure the lift anchor and/or prestressing strands due to concrete dimensions, such as insufficient concrete cover adjacent the lift anchor, prestressing strands, and/or other reinforcement. Reconfiguration may be complicated with prior art lift anchors, for example those that are fabricated as a single piece, that incorporate lower strength materials or configurations, or that require additional components, such as ties, for attaching the lift anchor to prestressing strands and/or other reinforcement.

The lift anchor may be coupled with a recess insert configured to isolate the exposed portion from the adjacent concrete. As fresh concrete is placed, the recess insert may prevent contact of the concrete with the exposed portion of the lift anchor. When the concrete has cured, the recess insert may be disassembled, leaving the lift anchor partly embedded in the concrete, and partly exposed for connecting hooks, cables, chains, and other lifting and transporting equipment. Selection of a recess insert and lift anchor, and the number and location of lift anchors, may be finalized relatively early in the design phase. Last-minute modifications to or substitution for a pre-selected lift anchor may be complicated, untimely, and costly.

A lift anchor and recess insert that has a high strength-to-size ratio, is compact, can readily accommodate different loading configurations, and comprises a relatively straightforward manufacture, is desirable.

BRIEF DESCRIPTION OF THE INVENTION

A recess insert for a lift anchor assembly in a precast Portland cement concrete shape. The lift anchor assembly has a bilaterally symmetrical lift anchor comprising a lifting end, and an anchor leg end. The lifting end comprises an opening therethrough. The recess insert comprises a semicircular shaped shell that defines an opening, a top cap shaped to cover the opening, at least one anchoring clip on the top cap, adapted to engage the opening of a lift anchor when the recess insert is cast with a lift anchor assembly in a precast Portland cement concrete shape for securing the top cap to the semicircular shaped shell. The top cap also has a disengagement plane wherein the at least one anchoring clip can be disengaged from the lift anchor when cut through the disengagement plane.

A recess insert for a lift anchor assembly in a precast Portland cement concrete shape. The lift anchor assembly has a bilaterally symmetrical lift anchor comprising a lifting end, and an anchor leg end. The lifting end comprises an opening therethrough. The recess insert comprises a semicircular shaped shell defining an opening, a top cap shaped to cover the opening, at least one anchoring clip on the top cap, adapted to engage the opening of a lift anchor when the recess insert is cast with a lift anchor assembly in in a precast Portland cement concrete shape for securing the top cap to the semicircular shaped shell. The top cap has an aperture adjacent the at least one anchoring clip for enabling access to disengage at least one anchoring clip from the lift anchor.

A method of removing a top cap having at least one latching clip secured to an opening in a lift anchor coupled to a recess insert thereby securing the top cap to the recess insert by cutting through a disengagement plane in the top cap thereby disengaging the at least one latching clip from the lift anchor.

DETAILED DESCRIPTION OF EMBODIMENTS OF THE INVENTION

The invention may be described herein in the context of exemplary embodiments, two or more of which may share features and functionalities. A subsequent description of a prior detailed description of shared features and functionalities herein may be omitted except as necessary for a complete understanding of the embodiments. It should be noted that one or more exemplary embodiments of the invention in the form of Portland cement concrete recess inserts and lift anchor assemblies may have applicability in an environment different than that described herein, and that the invention may be realized in other than the disclosed exemplary embodiments. Such embodiments may not be construed as limiting the scope of the claims.

Figure 1:
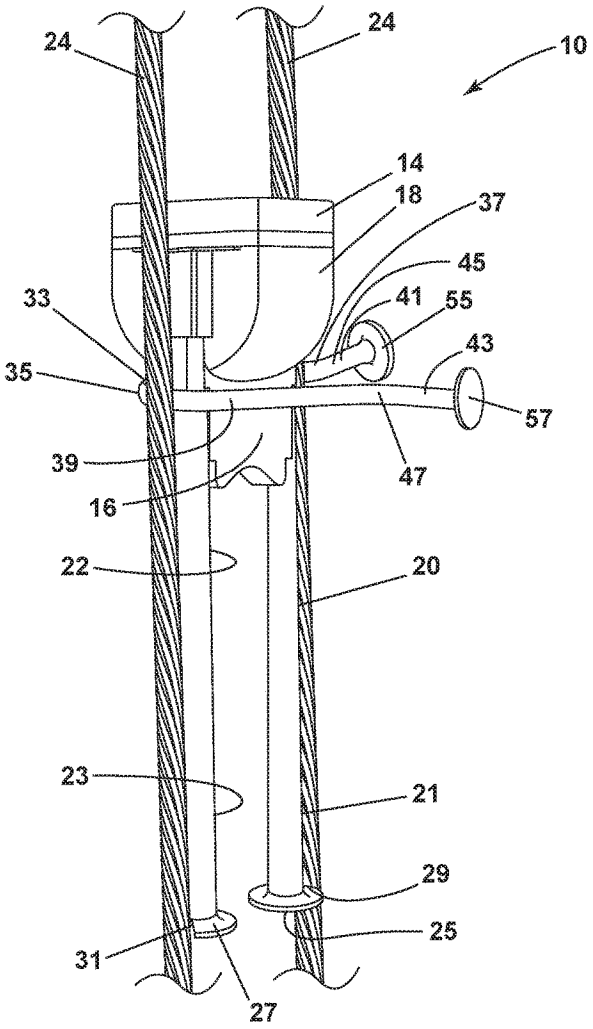
FIG. 1 is a perspective view of a precast Portland cement concrete lift anchor assembly and recess insert according to an exemplary embodiment of the invention.

Referring now to the figures, and to FIG. 1 in particular, an exemplary embodiment according to the disclosure of a precast Portland cement concrete lift anchor assembly 10. The precast concrete lift anchor assembly 10 may include a lift anchor 16, a recess insert 18 and a top cap 14. A pair of pre-stressing strands 24 may engage a portion of the lift anchor assembly 10 to aid in aligning or holding the lift anchor assembly 10 in place prior to casting the Portland cement concrete. In addition, the lift anchor assembly 10 may comprise elongated first and second anchor legs 20, 22 coupled to the lift anchor 16. The legs 20, 22 may be a cylindrical rod-like members having distal ends 21, 23, respectively, that terminate in the concrete slab (not shown) after casting. The anchor legs 20, 22 may be fabricated of a material capable of being forged or threaded, and having sufficient strength and durability for the purposes described herein, examples of which may include iron or steel.

Each anchor leg 20, 22 may comprise an elongate circular steel rod-like member having a proximal end rigidly coupled to the lift anchor 16 in a suitable manner, such as by welding. The distal end of each leg may terminate in a generally circular forged foot 25, 27 disposed orthogonally to the anchor legs 20, 22, respectively. Each anchor foot 25, 27 may include an arcuate recess respectively 29, 31, of a sufficient diameter to accommodate a pre-stressing strand 24 to enable the prestressing strand 24 to extend closely along an anchor leg 20, 22, respectively. While the anchor legs 20, 22 are illustrated as substantially straight and parallel, it should be recognized that the anchor legs 20, 22 could have an elbow or bend and the degree of angle of the elbow or bend can be included or varied without departing from the scope of the disclosure. Additionally, while the anchor legs 20, 22 are also illustrated as steel rods with a generally circular forged foot, the shape and size of the legs 20, 22 and the footings 25, 27 can vary without departing form the scope of disclosure.

The lift anchor assembly 10 can also comprise a divergent leg shear bar 33, welded or otherwise securely coupled to the lift anchor assembly 10. The divergent leg shear bar 33 can be characterized as a generally U-shaped member comprising a U-shaped portion 35 transitioning to a pair of generally parallel spaced-apart legs 37, 39. The legs 37, 39 can transition to inclined legs 41, 43, respectively, through leg bends 45, 47, respectively. Each inclined leg 41, 43 may terminate in a forged circular foot 55, 57, respectively. While the legs 37, 39 are illustrated with a slight bend 45, 47, it should be recognized that the degree of angle or bend, if any, can be varied without departing from the scope of the disclosure. Additionally, while the legs 37, 39 are also illustrated steel rods with a generally circular forged foot 55, 57, the shape and size of the legs 37, 39 and the footings 55, 57 can vary without departing form the scope of disclosure. For example, legs 37, 39 could be made from coil or treaded rod with lug nuts or wing nuts used as feet.

Figure 2B:
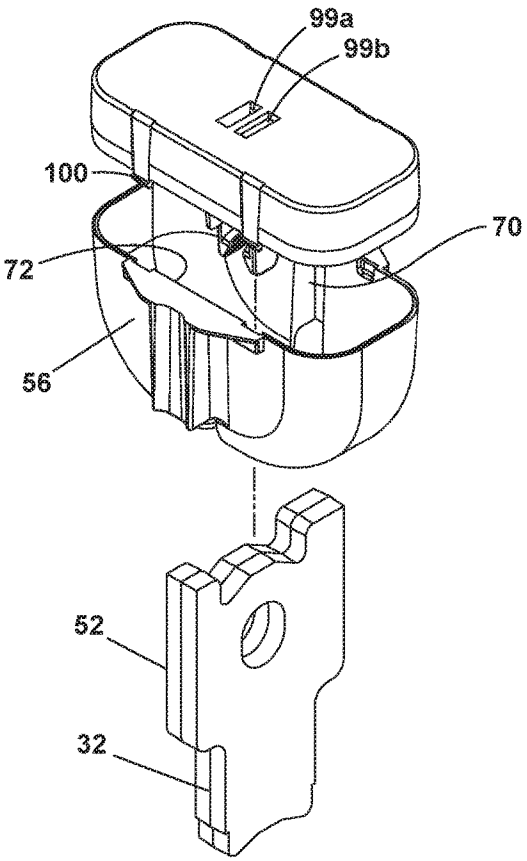
FIG. 2B is a rear elevation view of the lift anchor assembly illustrated in FIG. 2A showing the relative configurations a lift anchor, a recess insert, and top cap.
Figure 2A:
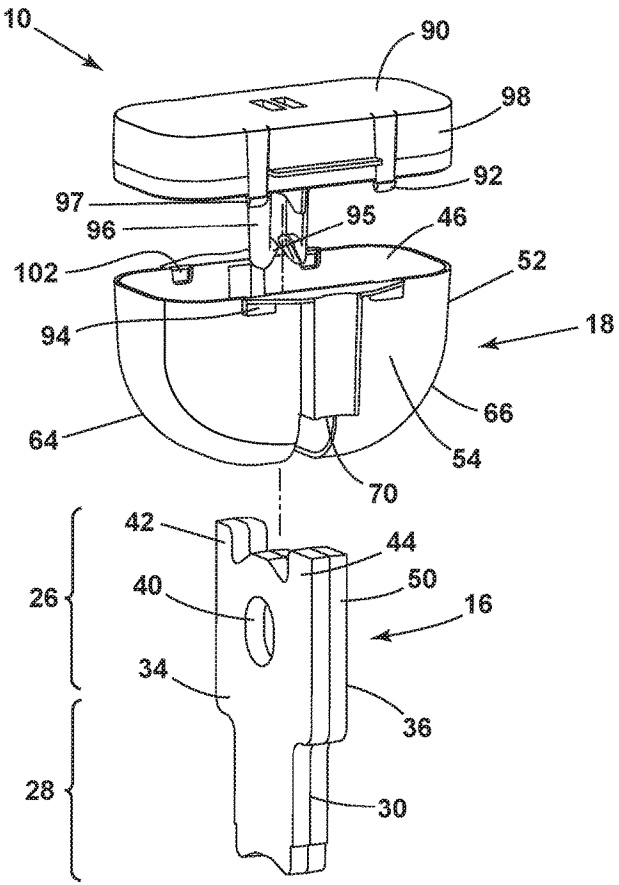
FIG. 2A is a front elevation view of the lift anchor assembly illustrated in FIG. 1 showing the relative configurations a lift anchor, a recess insert, and top cap.

FIGS. 2*a* and 2*b* illustrate exemplary front and rear perspective views of the lift anchor assembly 10 comprising the lift anchor 16 (without legs), a recess insert 18, and a top cap 14 in accordance with one aspect of the present disclosure. The lift anchor assembly 10 is configured to be cast into Portland cement concrete for the purpose of providing a lift anchor for the concrete.

The lift anchor 16 can be characterized by a uniform thickness and be defined by a somewhat T-shaped body, comprising a lifting end 26 and a generally rectangular anchor leg end 28. The lifting end 26 may include a contact opening 40 extending from a first contact face 34 through to a second contact face 36. The contact opening 40 may be configured to connect the lift anchor 16 with a lifting apparatus, such as a hook, a clutch, a carabiner, and the like, and may be circular, oval, a stadium or discorectangle, or another suitable shape. The contact opening 40 is illustrated for purposes of exemplification as having an oval shape.

The lifting end 26 can be characterized by a pair of ears 42, 44 defined by opposing planar side walls 50, 52 and opposing planar contact faces 34, 36, with the contact opening 40 therebetween. The planar side walls 50, 52 transition to planar side walls 30, 32 to define the generally rectangular lift anchor leg end 28. As discussed, the anchor leg end 28 can be configured to attach to or be integrally formed with legs 20, 22 and the shear bar 33. One way to attach legs 20, 22 and shear bar 33 to the lift anchor leg end 28 is by welding.

The recess insert 18 can comprise a somewhat semicircular shaped body or shell 52 characterized by opposing sidewalls 54, 56, convex curved walls 64, 66, and lift anchor engagement channels 70, 72. The lift anchor engagement channels 70, 72 can be configured to engage ears 44, 42 respectively, to allow the lift anchor 16 to slide in to recess insert 18. The semicircular shell defines an opening 46 to provide access to the lifting end 26 of lift anchor 16. In other words, the recess insert 18 forms a cavity in the concrete slab 12 which keeps the opening 40 in the lifting end 26 of the lift anchor 16 exposed and accessible for connecting of lifting equipment (not shown). Exterior of engagement channels 70, 72 on the outer surface of side walls 54, 56 can be provided concave channels 58, 60 for engaging pre-stressing strands 24.

The lift anchor assembly 10 can further comprise a bubble top or top cap 14 configured to close or cover the opening 46 during casting. The top cap 14 can be characterized by a top planar surface 90 circumscribing an upper end of a raised wall 98 with the shape of the raised wall 98 and the top planar surface 90 generally comprising a complementary shape to opening 46 defined by semicircular shell 52. The lower end of raised wall 98 can comprise one or more attachment hooks 92 and one or more pivoting hooks 100 configured to engage slots 94 and pivoting bars 102, respectively, provided in the recess insert 18. While illustrated with two attachment hooks 92 on one side of the top cap 14, and two pivoting hooks 100 on the other side of the top cap 14, it should be recognized that one or more attachment or pivoting hooks 92, 100 could be used without limiting the scope of the disclosure. In an exemplary embodiment, the top cap 14 can be made of plastic to allow the attachment hooks 92 to snap engage with slots 94.

The top cap 14 can further comprise a pair of latching clips 96 configured to engage the opening 40 in the lifting end 26 of lift anchor 16 surrounded by recess insert 18. As illustrated, the pair of latching clips 96 protrude from the top cap 14 toward the opening 40 of the lifting end 26 generally perpendicularly relative to the planar top 90. Each latching clip 96 can comprise a base portion 97 fixedly mounted to the top cap 14 and a hook 95 extending from the base portion 97. The opening 40 in the lift anchor 16 can be sandwiched and secured between the pair of latching clips 96. While this embodiment contemplates a pair of latching clips 96, it should be recognized that one or more clips could be used to secure the top cap 14 to the opening 40 in the lift anchor 16 without limiting the scope of the invention. Once again, it is contemplated that the hook 95 can be configured to snap into engagement with the opening 40 of the lift anchor 16, thus securing the top cap 14 to the recess insert 18.

Figure 3:
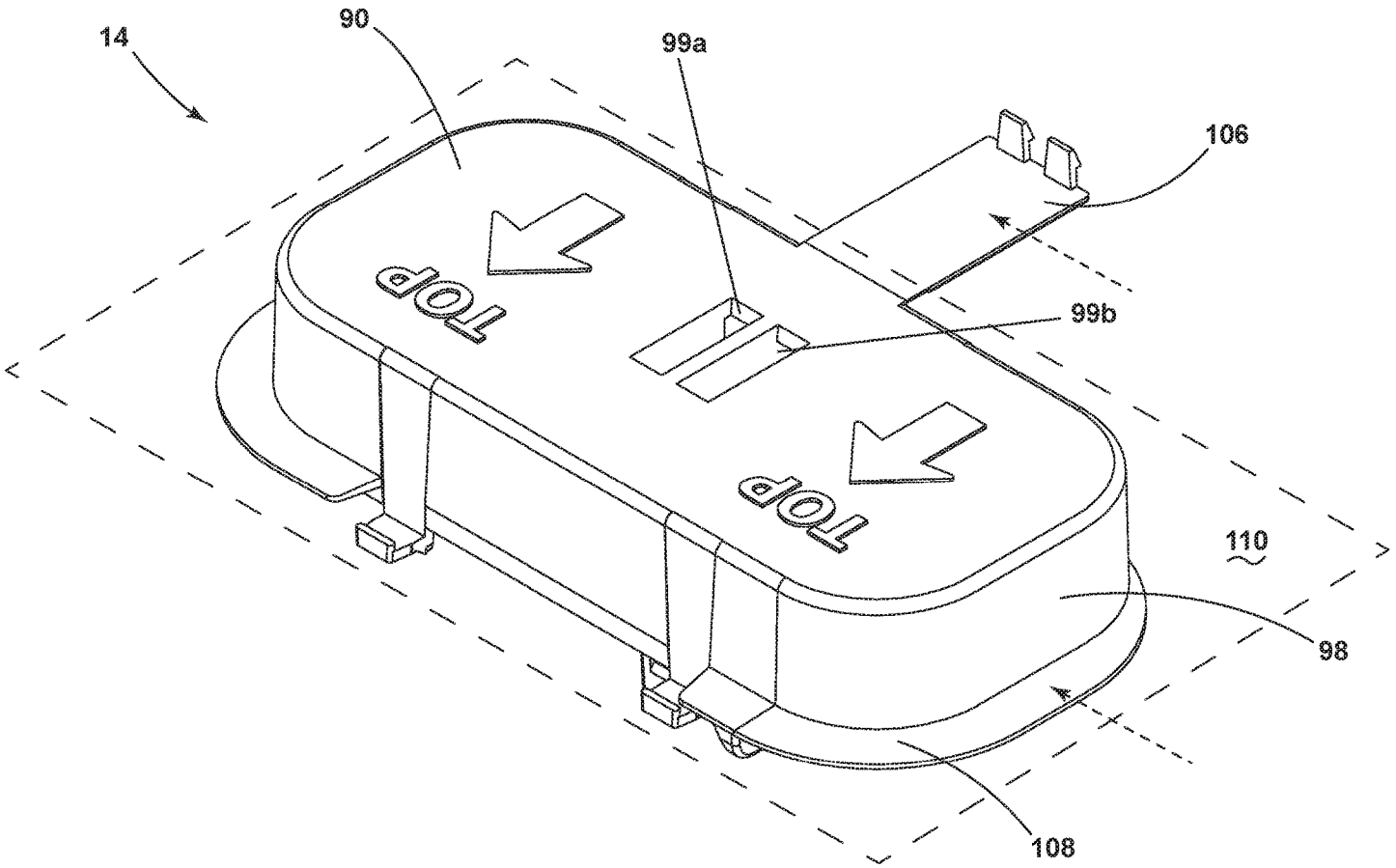
FIG. 3 is a perspective view of the top cap illustrated in FIGS. 2A & 2B.

As best shown in FIGS. 2B and 3, the top cap 14 can further comprise a pair of apertures 99*a*, 99*b*, in the top planar surface 90 positioned adjacent to and above the pair of latching clips 96. In this arrangement, apertures 99*a*, 99*b* can be provided to allow a tool such as a pair of pliers, a screwdriver or other tool to access to the latching clip 96. A protection flap 106 can be provided to fold over and cover apertures 99*a*, 99*b* to prevent concrete from filling the apertures 99*a*, 99*b* during casting. Alternatively, tape or other covering could be used to prevent concrete from filling the apertures 99*a*, 99*b* during casting.

The top cap 14 can further comprise a flange 108 positioned around an outer portion of the raised wall 98. The flange 108 denotes a disengagement plane 110 that identifies the portion of the top cap 14 that should protrude above or outside the Portland cement concrete when cast. In other words, the flange 108 can be used as an indicator of insertion level of the lift anchor assembly 10 when cast in Portland cement concrete and thereby helps appropriately position recess insert 18 and lift anchor 16 prior to casting.

In operation, one or more lift anchor assemblies 10 are positioned around a concrete slab 12. Each lift anchor assembly 10 has a closed top cap 14 covering the recess opening 46 in the semicircular shell 52 of the recess insert 18. Each top cap 14 is secured to the opening 40 in the lift anchor 16, thus securing the top cap 14 to the recess insert 18. After casting, each top cap 14 must be removed in order to access the lift anchor 16. One method of removing each top cap 14 is to cut through the top cap 14 at the disengagement plane 110. Cutting at the disengagement plane 110 will cut through the latching clips 96 and will disengage the latching clips 96 from opening 40 and thereby allow the removal the top cap 14. Another method of removing each top cap 14 is by accessing the latching clips 96 via apertures 99*a*, 99*b*. Plyers, screwdrivers or other tools may be inserted through the aperture 99*a*, 99*b* to bend the latching clip 96 so it no longer engages opening 40 and the top cap 14 can be removed. While this method contemplates reusability of the top cap 14, it also understood that any tool or object that breaks or moves the latching clip 96 so it no longer engages the opening 40 is contemplated by the present disclosure.

Figure 4B:
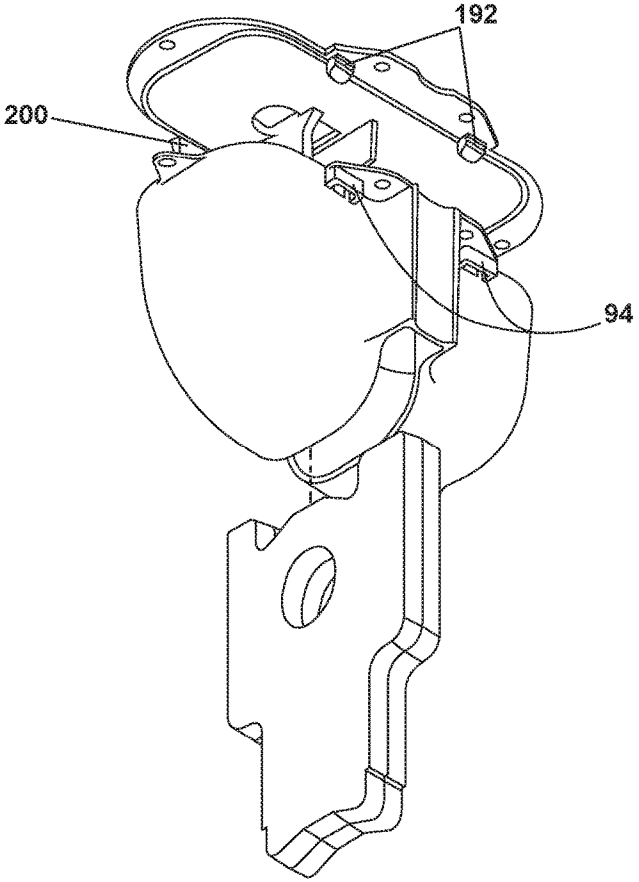
FIG. 4B is a rear elevation view of the lift anchor assembly illustrated in FIG. 4A showing the relative configurations a lift anchor, a recess insert, and top cap.
Figure 4A:
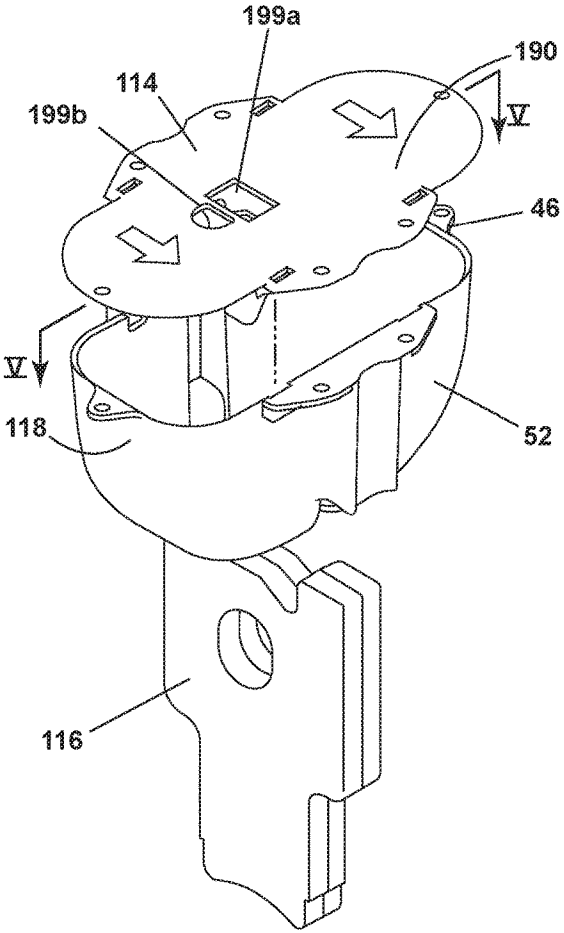
FIG. 4A is a front elevation view of another lift anchor assembly illustrated in FIG. 1 showing the relative configurations a lift anchor, a recess insert, and top cap.

FIGS. 4A and 4B illustrate an alternate front and rear perspective embodiments of the top cap 114 of lift anchor assembly 10. In this embodiment, the lift anchor 116 and recess insert 118 are substantially identical to the lift anchor 16 and recess insert 18 of FIGS. 2A, 2B & 3. Accordingly, these elements will not be further discussed. Other like parts will be identified with like numerals increased by 100, with it being understood that the description of the like parts is consistent unless otherwise unless otherwise noted.

In FIGS. 4A & 4B, the top cap 114 can be characterized by a top planar surface 190 of generally complementary shape to opening 46 defined by semicircular shell 52 (without the raised wall 98). Similar to top cap 14, top cap 114 can comprise one or more attachment hooks 192 configured to engage slots 94 provided in the recess insert 18. Once again, while illustrated with two attachment hooks 192 on each side of the top cap 14, it should be recognized that one or more attachment hooks 192 (or pivoting hooks) could be used without limiting the scope of the disclosure. Also, the top cap 114 can be made of plastic to allow the attachment hooks 192 to snap engage with slots 94.

Figure 5:
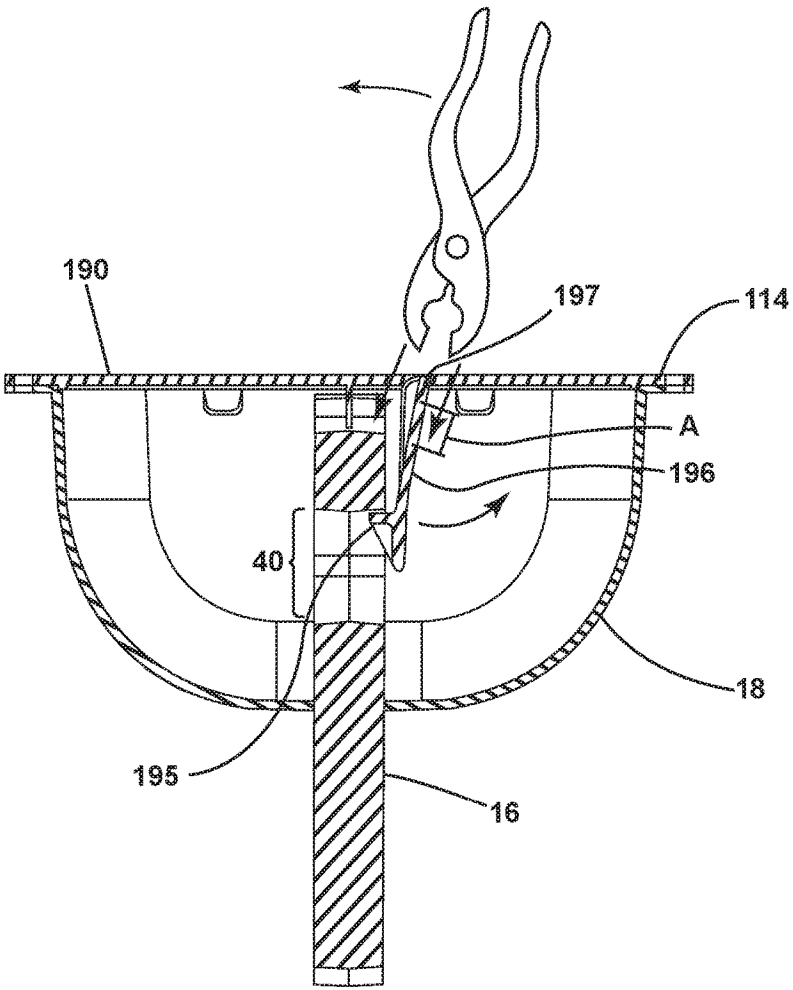
FIG. 5 is a side view of the lift anchor assembly illustrated in FIGS. 4A & 4B.

As best illustrated in FIG. 5, the top cap 114 can further comprise a latching clip 196 configured to engage the opening 40 in the lifting end 26 of lift anchor 16 surrounded by recess insert 18. The latching clip 196 can comprise a base portion 197 fixedly mounted to the top cap 114 and a hook 195 extending from the base portion 197. Once again, it is contemplated that the hook 195 can be configured to snap into engagement with the opening 40 of the lift anchor 16.

The latching clip 196 can protrude from the top cap 114 toward the opening 40 of the lifting end 26 and at an angle (A) relative to the planar top 190. In this arrangement, apertures 199*a*, 199*b* can be provided adjacent the base 97 to allow plyer's, a screwdriver or other tool access to the latching clip 196. Similar to the earlier embodiment, after casting, plyer's, screwdrivers or other tools may be inserted through the apertures 199*a*, 199*b* to bend the latching clip 196 so it no longer engages opening 40 and the top cap 14 may be removed. While it is contemplated the top caps are removable for re-use purposes, it also understood that any tool or object that breaks or moves the latching assembly away from the opening 40 is contemplated by the present disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A recess insert for a lift anchor assembly precast in Portland cement concrete, the lift anchor assembly having a bilaterally symmetrical lift anchor comprising a lifting end, and an anchor leg end, the lifting end comprising an opening therethrough, the recess insert comprising:

a semicircular shaped shell configured to surround the lifting end opening and comprising an upper rim defining a top opening and at least one aperture adjacent to top opening;

a top cap configured to snap engage the semicircular shaped shell and shaped to cover the top opening, the top cap defined by a top planar surface, a peripheral wall having lower rim defining a bottom of the top cap and having a height extending between the lower rim and the top planar surface; the peripheral wall defining a cavity below the top planar surface, and a flange extending outwardly from the peripheral wall defining a disengagement plane separate from and parallel to the top planar surface, the top cap having at least one hook extending from the lower rim for engaging the at least one aperture in the semicircular shaped shell such that the top cap engages the semicircular shaped shell and wherein one of the flange or the lower rim of the peripheral wall abuts the upper rim of the semicircular shaped shell such that the peripheral wall, flange, and top planar surface are above the upper rim of the of the semicircular shaped shell when the top cap is attached to the semicircular shaped shell; the semicircular shaped shell with the top cap configured to be embedded in the Portland cement concrete with the flange defining a positioning indicator of insertion level of the recess insert prior to casting; and at least one latching clip extending from inside the top planar surface and through the cavity of the top cap below the disengagement plane and adapted to engage the lifting end opening of the lift anchor when the recess insert is cast in precast Portland cement concrete shape, for securing the top cap to the semicircular shaped shell and for allowing separation of the top cap from the shell when cut through disengagement plane.

2. The recess insert of claim 1 wherein at least a portion of the peripheral wall of the top cap protrudes above Portland cement concrete when cast.

3. The recess insert of claim 1 wherein the at least one latching clip further comprises a hook for engaging the opening of the lift anchor.

4. The recess insert of claim 3 wherein the hook is configured to snap into engagement with the opening of the lift anchor.

5. The recess insert of claim 3 wherein the latching clip protrudes from the center of top cap.

6. The recess insert of claim 1 further comprising at least one concave groove positioned on a side of the recess insert for engaging pre-pressed strand.

7. The recess insert of claim 1 wherein the flange extends around at least a portion of the peripheral wall.

8. The recess insert of claim 1 wherein the top cap further comprises at least one aperture extending through the top planar surface and located adjacent to the at least one latching clip.

9. The recess insert of claim 8 further comprising a cover configured to selectively close the at least one aperture.

10. The recess insert of claim 9 wherein the cover further comprises at least one hook configured to snap engage in the aperture.

11. The recess insert of claim 1 wherein the peripheral wall comprises at least one attachment hook for selectively attaching the top cap to the recess insert.

12. The recess insert of claim 11 wherein the recess insert further comprises at least one slot for receiving the at least one attachment hook.

13. A recess insert for a lift anchor assembly precast in Portland cement concrete the lift anchor assembly having a bilaterally symmetrical lift anchor comprising a lifting end, and an anchor leg end, the lifting end comprising an opening therethrough, the recess insert comprising:

a semicircular shaped shell configured to surround the lifting end opening and comprising an upper rim defining a top opening;

a top cap configured to snap engage the semicircular shaped shell and to cover the top opening, the top cap defined by a top planar surface, a disengagement plane separate from and parallel to the top planar surface, and a peripheral wall having a lower rim defining a bottom of the top cap and a height extending between the top planar surface and the lower rim; the peripheral wall defining a cavity below the top planar surface, the top cap being configured to attach to the semicircular shaped shell wherein the lower rim of the peripheral wall abuts the upper rim of the semicircular shaped shell such that the peripheral wall and top planar surface are above the upper rim of the of the semicircular shaped shell when the top cap is attached to the semicircular shaped shell; the top planar surface further comprising at least two apertures extending through the top planar surface;

a protection flap covering the at least two apertures and having a first end pivotably attached to the top cap and a second end comprising at least one hook for snap engaging at least one of the two apertures;

at least one latching clip located adjacent one of the at least two apertures and extending from inside the top planar surface of the top cap below the lower rim and adapted to engage the lifting end opening of the lift anchor when the recess insert is cast in precast Portland cement concrete shape, for securing the top cap to the semicircular shaped shell.

14. The recess insert of claim 13 wherein a flange defines the disengagement plane.

15. The recess insert of claim 14 wherein the flange extends around at least a portion of the peripheral wall and projects outward from the peripheral wall.

16. The recess insert of claim 13 further comprising a cover configured to selectively close the at least one aperture in the top planar surface.

17. The recess insert of claim 16 wherein the cover further comprises at least one hook configured to snap engage in the aperture.

18. The recess insert of claim 17 wherein at least a portion of the peripheral wall of the top cap protrudes above Portland cement concrete when cast.

19. The recess insert of claim 13 wherein the peripheral wall further comprises at least one attachment hook and the recess insert further comprises at least one slot for receiving the at least one attachment hook for selectively attaching the top cap to the recess insert.

* * * * *